US010811851B1

(12) United States Patent
Gozawa et al.

(10) Patent No.: US 10,811,851 B1
(45) Date of Patent: Oct. 20, 2020

(54) SPARK PLUG

(71) Applicant: NGK SPARK PLUG CO., LTD., Nagoya-shi (JP)

(72) Inventors: Tatsuya Gozawa, Nagoya (JP); Kenji Ban, Nagoya (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 16/877,897

(22) Filed: May 19, 2020

(30) Foreign Application Priority Data

May 20, 2019 (JP) ..... 2019-094580

(51) Int. Cl.
*H01T 13/06* (2006.01)
*H01T 13/20* (2006.01)

(52) U.S. Cl.
CPC ..... *H01T 13/06* (2013.01); *H01T 13/20* (2013.01)

(58) Field of Classification Search
USPC ..... 123/169 EL
See application file for complete search history.

(56) References Cited

U.S. PATENT DOCUMENTS 6,013,973 A * 1/2000 Sato ..... H01T 13/54 313/140
8,584,648 B2 * 11/2013 Chiera ..... F02P 15/001 123/266
10,714,906 B1 * 7/2020 Ban ..... H01T 13/06
2012/0248964 A1 * 10/2012 Thomas ..... H01T 13/54 313/141
2015/0194793 A1 * 7/2015 Yamanaka ..... H01T 13/32 313/141

FOREIGN PATENT DOCUMENTS

JP 11-224763 A 8/1999

* cited by examiner

*Primary Examiner* — Ashok Patel
(74) *Attorney, Agent, or Firm* — Leason Ellis LLP

(57) ABSTRACT

A spark plug includes: a center electrode; a ground electrode that is provided such that a gap for spark discharge is formed between the center electrode and the ground electrode; and a plug cover covering the center electrode and the ground electrode from a front side. The plug cover has a through hole, wherein the plug cover includes a diameter reduction portion formed in a range of 0.1 mm or less from an outer open end of the through hole in a direction along a central axis of the through hole and having a diameter gradually decreasing from the outer open end toward an inner open end of the through hole. A relationship of 0 mm<x−y<0.2 mm is satisfied, where x is a diameter at the outer open end, and y is a diameter at an inner end of the diameter reduction portion.

2 Claims, 4 Drawing Sheets

Fig.4

| | x | y | x-y | a | b | PRE-IGNITION | COMBUSTION SPEED | OVERALL EVALUATION |
|---|---|---|---|---|---|---|---|---|
| 1 | 1.000 | 1.000 | 0.000 | 0.500 | 0.500 | 0 | 1 | 1 |
| 2 | 1.005 | 1.000 | 0.005 | 0.502 | 0.502 | 1 | 1 | 2 |
| 3 | 1.010 | 1.000 | 0.010 | 0.505 | 0.505 | 1 | 1 | 2 |
| 4 | 1.050 | 1.000 | 0.050 | 0.525 | 0.525 | 1 | 1 | 2 |
| 5 | 1.100 | 1.000 | 0.100 | 0.550 | 0.550 | 1 | 1 | 2 |
| 6 | 1.150 | 1.000 | 0.150 | 0.575 | 0.575 | 1 | 1 | 2 |
| 7 | 1.200 | 1.000 | 0.200 | 0.600 | 0.600 | 1 | 0 | 1 |
| 8 | 1.250 | 1.000 | 0.250 | 0.625 | 0.625 | 1 | 0 | 1 |
| 9 | 2.000 | 2.000 | 0.000 | 1.000 | 1.000 | 0 | 1 | 1 |
| 10 | 2.005 | 2.000 | 0.005 | 1.002 | 1.002 | 1 | 1 | 2 |
| 11 | 2.010 | 2.000 | 0.010 | 1.005 | 1.005 | 1 | 1 | 2 |
| 12 | 2.050 | 2.000 | 0.050 | 1.025 | 1.025 | 1 | 1 | 2 |
| 13 | 2.100 | 2.000 | 0.100 | 1.050 | 1.050 | 1 | 1 | 2 |
| 14 | 2.150 | 2.000 | 0.150 | 1.075 | 1.075 | 1 | 1 | 2 |
| 15 | 2.200 | 2.000 | 0.200 | 1.100 | 1.100 | 1 | 0 | 1 |
| 16 | 2.250 | 2.000 | 0.250 | 1.125 | 1.125 | 1 | 0 | 1 |
| 17 | 1.100 | 1.000 | 0.100 | 0.560 | 0.540 | 1 | 1 | 2 |
| 18 | 1.100 | 1.000 | 0.100 | 0.540 | 0.560 | 1 | 3 | 4 |
| 19 | 2.100 | 2.000 | 0.100 | 1.060 | 1.040 | 1 | 1 | 2 |
| 20 | 2.100 | 2.000 | 0.100 | 1.040 | 1.060 | 1 | 3 | 4 |

SPARK PLUG

This application claims the benefit of priority to Japanese Patent Application No. 2019-094580, filed May 20, 2019, which is incorporated herein by reference in its entirety.

FIELD OF THE INVENTION

The present invention relates to a spark plug.

BACKGROUND OF THE INVENTION

As an ignition spark plug used for an internal combustion engine, for example, a gasoline engine, a spark plug provided with an auxiliary chamber covering a center electrode and a ground electrode from the front side has been known (for example, Japanese Patent Application Laid-Open (kokai) No. H11-224763).

In general, a spark plug having an auxiliary chamber causes spark discharge in a spark gap, which is for causing a spark and is the gap between a center electrode and a ground electrode, and then flame is initially generated in the auxiliary chamber. Thereafter, the pressure in the auxiliary chamber is increased by the flame, and the flame jets out from the interior of the auxiliary chamber through a through hole to the outside of a plug cover due to the pressure. Then, fuel gas in a combustion chamber is burned using the flame having jetted out as an ignition source, whereby explosive combustion occurs in the combustion chamber.

Japanese Patent Application Laid-Open (kokai) No. H11-224763 discloses a spark plug in which a through hole is provided at the position of a spark gap in a direction along the axial line of the spark plug and a through hole is also provided at a position on the frontmost side of the auxiliary chamber.

Problems to be Solved by the Invention

The positions of through holes have been studied as in the spark plug described in Japanese Patent Application Laid-Open (kokai) No. H11-224763, but the shapes of through holes are not considered to have been sufficiently studied, and there is room for further improvement from the viewpoint of improvement in fuel economy.

Furthermore, the inventors have found that the outer open end of the through hole is exposed to flame by continuous spark ignition and thus the temperature of the outer open end is excessively increased, and have found that, as a result of this, the phenomenon of causing self-ignition before spark ignition (so-called "pre-ignition") occurs. Therefore, an object of the present invention is to provide a technology that inhibits occurrence of pre-ignition and also improves fuel economy.

SUMMARY OF THE INVENTION

Means for Solving the Problems

The present invention has been made to solve the above-described problem and can be embodied in the following modes.

(1) According to an aspect of the present invention, a spark plug is provided. The spark plug includes: a center electrode; a ground electrode that is provided such that a gap for spark discharge is formed between the center electrode and the ground electrode; and a plug cover covering the center electrode and the ground electrode from a front side of the spark plug, the plug cover having a through hole, wherein the plug cover includes a diameter reduction portion formed in a range of 0.1 mm or less from an outer open end of the through hole in a direction along a central axis of the through hole and having a diameter gradually decreasing from the outer open end toward an inner open end of the through hole, and, a relationship of 0 mm<x−y<0.2 mm is satisfied, where x is a diameter at the outer open end, and y is a diameter at an inner end of the diameter reduction portion. In the spark plug of this aspect, by setting x−y to be greater than 0 mm, exposure of the outer open end to flame can be inhibited. Thus, the temperature of the outer open end can be inhibited from being excessively increased. As a result, occurrence of pre-ignition can be inhibited. Moreover, in the spark plug of this aspect, by setting x−y to be less than 0.2 mm, a decrease in the density of flame at the outer open end can be inhibited. Thus, a decrease in the jetting speed of flame jetting out can be inhibited. As a result, flame sufficiently spreads in a combustion chamber, and fuel economy is improved.

(2) In the spark plug of the above aspect, a distance from the central axis to a frontmost portion of the outer open end may be larger than a distance from the central axis to a rearmost portion of the outer open end. In the spark plug of this aspect, flame jets to the center side of the combustion chamber, so that the flame sufficiently spreads in the combustion chamber, and fuel economy is improved.

The present invention can be embodied in various forms, and can be embodied, for example, in forms such as an engine head on which a spark plug is mounted.

BRIEF DESCRIPTION OF THE DRAWINGS

These and other features and advantages of the present invention will become more readily appreciated when considered in connection with the following detailed description and appended drawings, wherein like designations denote like elements in the various views, and wherein:

FIG. 4 is a diagram showing experimental results supporting the effects achieved by an embodiment.

DETAILED DESCRIPTION OF THE INVENTION

A. First Embodiment

Figure 1:
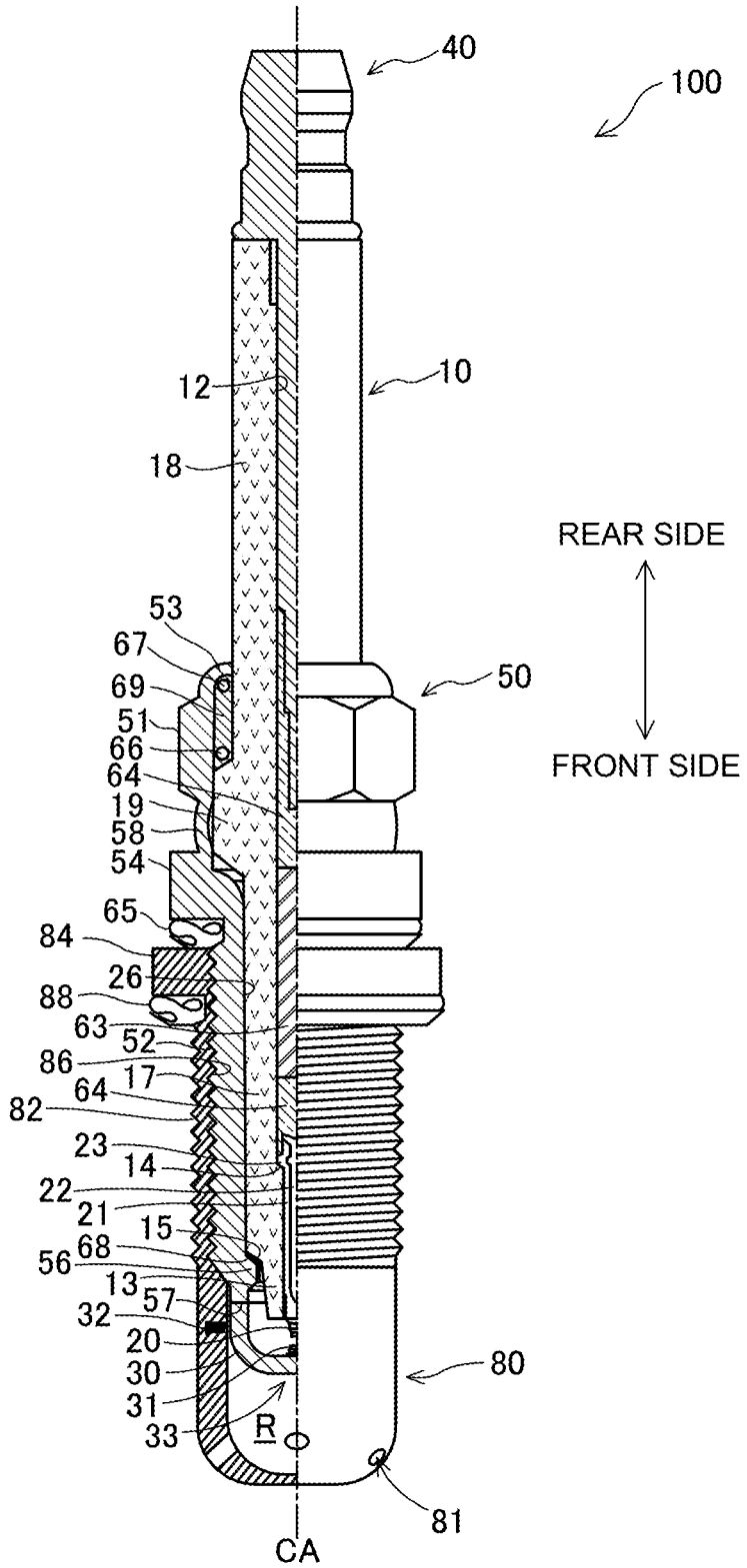
FIG. 1 is an explanatory diagram showing a partial cross section of a spark plug.

FIG. 1 is an explanatory diagram showing a partial cross section of a spark plug 100. In FIG. 1, with an axial line CA, which is the axis of the spark plug 100, as a boundary, the external appearance shape of the spark plug 100 is shown at the right side of the drawing sheet, and the cross-sectional shape of the spark plug 100 is shown at the left side of the drawing sheet. In the description of the present embodiment, the lower side of FIG. 1 is referred to as front side of the spark plug 100, and the upper side of FIG. 1 is referred to as rear side of the spark plug 100.

The spark plug 100 includes: an insulator 10 having an axial hole 12 along the axial line CA; a center electrode 20 provided in the axial hole 12; a tubular metal shell 50 disposed on the outer periphery of the insulator 10; a ground electrode 30 having a base end 32 fixed to the metal shell 50;

and a plug cover 80 covering the center electrode 20 and the ground electrode 30. Here, the axial line CA of the spark plug 100 is the same as the axial line of the center electrode 20.

The insulator 10 is a ceramic insulator formed by firing a ceramic material such as alumina. The insulator 10 is a tubular member disposed on the inner periphery of the metal shell 50 and having the axial hole 12 that is formed at a center thereof and in which a part of the center electrode 20 is housed at the front side and a part of a metal terminal 40 is housed at the rear side. A central trunk portion 19 having a large outer diameter is formed at the center in the axial direction of the insulator 10. A rear trunk portion 18 having a smaller outer diameter than the central trunk portion 19 is formed at the rear side of the central trunk portion 19. A front trunk portion 17 having a smaller outer diameter than the rear trunk portion 18 is formed at the front side of the central trunk portion 19. A leg portion 13 having an outer diameter that decreases toward the center electrode 20 side is formed at the further front side of the front trunk portion 17.

The metal shell 50 is a cylindrical metal member that surrounds and holds a portion, of the insulator 10, extending from a part of the rear trunk portion 18 to the leg portion 13. The metal shell 50 is, for example, formed from low-carbon steel, and entirely plated with nickel, zinc, or the like. The metal shell 50 includes a tool engagement portion 51, a seal portion 54, and a mounting screw portion 52 in order from the rear side. A tool for mounting the spark plug 100 to an engine head is fitted to the tool engagement portion 51. The mounting screw portion 52 is a portion that has an external thread formed on the outer periphery of the metal shell 50 over the entire circumference thereof and that is screwed into a screw groove 86 of the plug cover 80. The seal portion 54 is a portion formed in a flange shape at the root of the mounting screw portion 52. An annular gasket 65 formed by bending a plate is inserted and fitted between the seal portion 54 and a cover seal portion 84 of the plug cover 80. An end surface 57, at the front side, of the metal shell 50 has a hollow circular shape, and the front end of the leg portion 13 of the insulator 10 and the front end of the center electrode 20 project from the center of the end surface 57.

A crimp portion 53 having a small thickness is provided at the rear side with respect to the tool engagement portion 51 of the metal shell 50. In addition, a compressive deformation portion 58 having a small thickness similar to the crimp portion 53 is provided between the seal portion 54 and the tool engagement portion 51. Annular ring members 66 and 67 are interposed between the inner peripheral surface of the metal shell 50 and the outer peripheral surface of the rear trunk portion 18 of the insulator 10 from the tool engagement portion 51 to the crimp portion 53, and the space between these ring members 66 and 67 is further filled with powder of talc 69. During manufacturing of the spark plug 100, the compressive deformation portion 58 becomes compressively deformed by pressing the crimp portion 53 to the front side such that the crimp portion 53 is bent inward. Due to the compressive deformation of the compressive deformation portion 58, the insulator 10 is pressed within the metal shell 50 toward the front side via the ring members 66 and 67 and the talc 69. Due to the pressing, the talc 69 is compressed in the axial line CA direction, whereby the airtightness in the metal shell 50 is increased.

The metal shell 50 has a metal shell inner step portion 56 formed so as to project on the inner periphery of the metal shell 50. In addition, the insulator 10 has an insulator step portion 15 located at the rear end of the leg portion 13 and formed so as to project on the outer periphery of the insulator 10. On the inner periphery of the metal shell 50, the metal shell inner step portion 56 is in contact with the insulator step portion 15 via an annular packing 68. The packing 68 is a member for maintaining the airtightness between the metal shell 50 and the insulator 10, and prevents outflow of combustion gas. In the present embodiment, a plate packing is used as the packing.

The center electrode 20 is a rod-shaped member in which a core material 22 having better thermal conductivity than an electrode member 21 is embedded inside the electrode member 21. The electrode member 21 is formed from a nickel alloy containing nickel as a main component, and the core material 22 is formed from copper or an alloy containing copper as a main component. For example, a noble metal tip formed from an iridium alloy or the like may be joined to an end portion, at the front side, of the center electrode 20.

A flange portion 23 is formed near an end portion, at the rear side, of the center electrode 20 so as to project at the outer peripheral side of the center electrode 20. The flange portion 23 is in contact with an axial hole inner step portion 14, which projects at the inner peripheral side in the axial hole 12 of the insulator 10, from the rear side, and positions the center electrode 20 within the insulator 10. The center electrode 20 is electrically connected at the rear side thereof to the metal terminal 40 via a seal body 64 and a ceramic resistor 63.

The ground electrode 30 is formed from an alloy containing nickel as a main component. The base end 32 of the ground electrode 30 is fixed to the end surface 57 of the metal shell 50. The ground electrode 30 extends along the axial line CA from the base end 32 toward the front side, and is bent at an intermediate portion thereof such that one side surface of a front end portion 33 of the ground electrode 30 faces the front end surface of the center electrode 20. A noble metal tip 31 is provided on the surface, of the front end portion 33 of the ground electrode 30, which faces the center electrode 20 side. A gap for spark discharge is formed between the noble metal tip 31 of the ground electrode 30 and the center electrode 20. Hereinafter, this gap is also referred to as "spark gap". The noble metal tip 31 is formed from, for example, platinum, iridium, ruthenium, rhodium, or an alloy thereof.

The plug cover 80 is a hollow member covering the center electrode 20 and the ground electrode 30 from the front side. The plug cover 80 of the present embodiment is formed from stainless steel. A space covered with the plug cover 80 is also referred to as an auxiliary chamber R. The auxiliary chamber R covers the spark gap. In the present embodiment, the auxiliary chamber R is a space surrounded by the insulator 10, the center electrode 20, the metal shell 50, the packing 68, and the plug cover 80. The screw groove 86 which is threadedly engaged with the mounting screw portion 52 of the metal shell 50 is formed on an inner wall of the plug cover 80, and the plug cover 80 is mounted to the metal shell 50 by screwing the metal shell 50 into the plug cover 80.

The plug cover 80 includes a screw portion 82 and the cover seal portion 84. The screw portion 82 is a portion that has an external thread formed on the outer periphery of the plug cover 80 over the entire circumference thereof and that is screwed into a screw groove of the engine head. The cover seal portion 84 is a portion formed in a flange shape at the root of the screw portion 82. An annular gasket 88 formed by bending a plate is inserted and fitted at the front side of the cover seal portion 84. The thickness of the plug cover 80 is not particularly limited, but may be, for example, about 1.5 mm to 3 mm.

The plug cover 80 is provided with a plurality of through holes 81 providing communication between the inside and the outside of the plug cover 80. By providing the through holes 81, fuel gas that is present in a combustion chamber of an engine can be caused to flow into the auxiliary chamber R, and flame generated in the auxiliary chamber R can be jetted to the outside of the plug cover 80.

In the spark plug 100 of the present embodiment, spark discharge is caused in the spark gap, and then flame is initially generated in the auxiliary chamber R. Thereafter, the pressure in the auxiliary chamber R is increased by the flame, and the flame jets out through the through holes 81 to the outside of the plug cover 80 due to this pressure. Then, combustion gas in the combustion chamber is burned using the flame having jetted out as an ignition source, whereby explosive combustion occurs in the combustion chamber.

Figure 2:
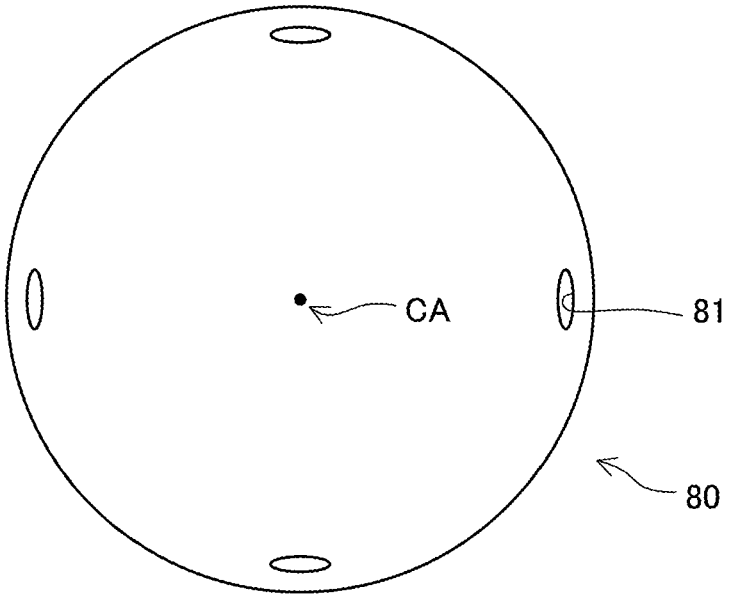
FIG. 2 is a schematic diagram of a plug cover as seen from a front side.

FIG. 2 is a schematic diagram of the plug cover 80 as seen from the front side. In the present embodiment, four through holes 81 are provided at equal intervals around the axial line CA. The number of through holes 81 is not limited thereto, and may be 3 or less or may be 5 or more. From the viewpoint of improvement in fuel economy, the number of through holes 81 is preferably equal to or greater than 2 and equal to or less than 8, and more preferably equal to or greater than 3 and equal to or less than 6.

Figure 3:
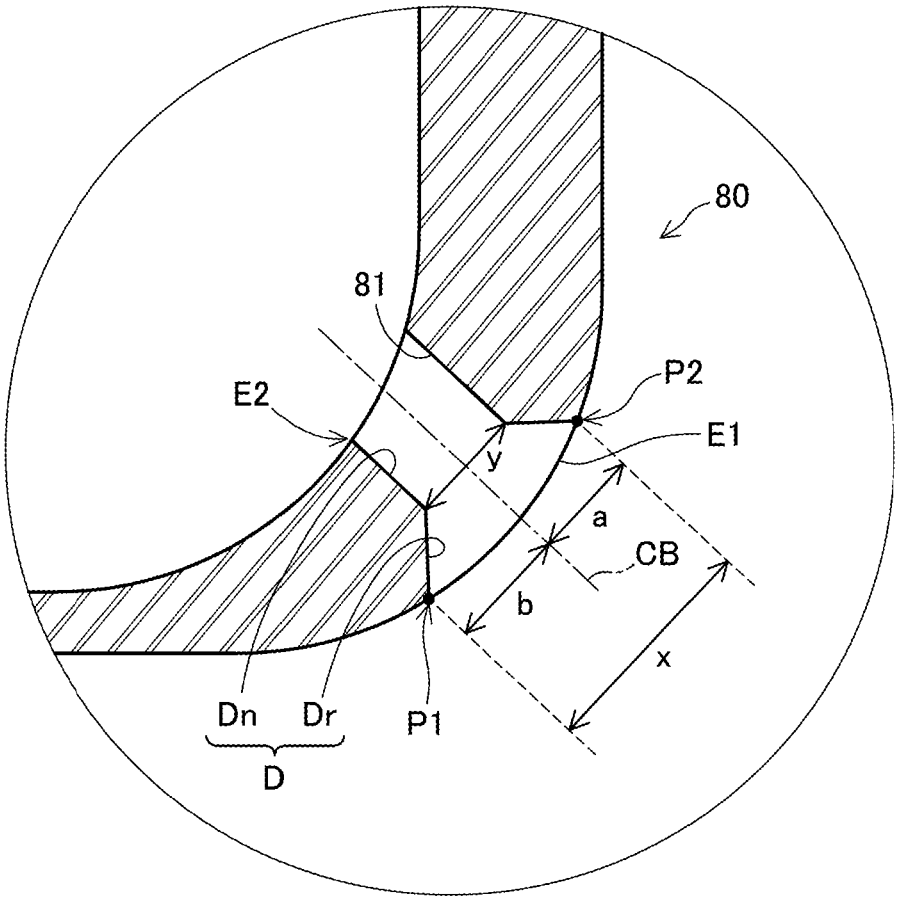
FIG. 3 is a schematic diagram for describing a cross-sectional shape of a through hole.

FIG. 3 is a schematic diagram for describing a cross-sectional shape of the through hole 81. In the present embodiment, the plug cover 80 includes a diameter reduction portion Dr having a diameter that gradually decreases from an outer open end E1 of the through hole 81 toward the inner open end E2 of the through hole 81. The diameter reduction portion Dr is formed in a range of 0.1 mm or less from the outer open end E1 in a direction along a central axis CB of the through hole 81. In other words, the plug cover 80 is provided with a through hole formation portion D in which the through hole 81 is formed, and the through hole formation portion D has an inner portion Dn including the inner open end E2 connected to the inner surface of the plug cover 80, and the diameter reduction portion Dr including the outer open end E1 connected to the outer surface of the plug cover 80. In the present embodiment, the diameter of the diameter reduction portion Dr gradually decreases in a range of 0.08 mm from the outer open end E1 in the direction along the central axis CB of the through hole 81.

In the spark plug 100 of the present embodiment, when a diameter at the outer open end E1 is denoted by x, and a diameter at the inner end of the diameter reduction portion Dr is denoted by y, the relationship of $0\ \text{mm} < x-y < 0.2\ \text{mm}$ is satisfied. Here, the diameter x at the outer open end E1 indicates the length of the line segment at the outermost side in the diameter reduction portion Dr among the line segments orthogonal to the central axis CB. The diameter y at the inner end of the diameter reduction portion Dr indicates the length of the line segment at the innermost side in the diameter reduction portion Dr among the line segments orthogonal to the central axis CB.

In the spark plug 100 of the present embodiment, by setting x−y to be greater than 0 mm, exposure of the outer open end E1 to flame can be inhibited as compared to the case where x−y is 0 mm. Thus, the temperature of the outer open end E1 can be inhibited from being excessively increased. As a result, occurrence of pre-ignition, which is the phenomenon of causing self-ignition before spark ignition, can be inhibited. From the viewpoint of inhibiting occurrence of pre-ignition, x−y is preferably greater than 0.01 mm, and more preferably greater than 0.05 mm.

Moreover, in the spark plug 100 of the present embodiment, by setting x−y to be less than 0.2 mm, a decrease in the density of flame at the outer open end E1 can be inhibited as compared to the case where x−y is equal to or greater than 0.2 mm. Thus, a decrease in the jetting speed of flame jetting out from the through hole 81 can be inhibited. As a result, flame sufficiently spreads in the combustion chamber, and the combustion speed of fuel gas is increased, so that fuel economy is improved. From the viewpoint of increasing the combustion speed, x−y is more preferably equal to or less than 0.15 mm.

Moreover, in the spark plug 100 of the present embodiment, a distance b from the central axis CB of the through hole 81 to a portion P1, at the frontmost side, of the outer open end E1 is larger than a distance a from the central axis CB to a portion P2, at the rearmost side, of the outer open end E1. With such a configuration, flame jetting out from the through hole 81 spreads to the front side. That is, flame jets to the center side of the combustion chamber, so that the flame sufficiently spreads in the combustion chamber, and fuel economy is improved. In the present embodiment, the plug cover 80 has the plurality of through holes 81, and the distance b is larger than the distance a in all the through holes 81. With such a configuration, flame jetting out from all the through holes 81 spreads to the front side, and thus fuel economy is further improved.

FIG. 4 is a diagram showing experimental results supporting the effects achieved by the present embodiment. In this experiment, as shown in FIG. 4, samples of spark plugs in which (i) the diameter x at the outer open end E1, (ii) the diameter y at the inner end of the diameter reduction portion Dr, (iii) the distance a, and (iv) the distance b were made different for each sample were produced.

Measurement of each of values of x, y, a, and b was performed by filling the through hole 81 with a resin, then cutting the plug cover 80 along a plane passing through the axial line CA and the central axis CB of the through hole 81, and measuring each of values of x, y, a, and b on the cut plane with a microscope. In this experiment, evaluation for pre-ignition and evaluation for combustion speed were made.

In the evaluation for pre-ignition, a sample was mounted to an in-line 4-cylinder naturally aspirated engine having a displacement of 1.3 L, and the engine was operated at an engine speed of 600 rpm under the condition of wide open throttle (WOT). Then, the frequency of pre-ignition was measured for each ignition timing defined by a crank angle. In general, as the ignition timing is advanced, pre-ignition is more likely to occur.

A point given when no pre-ignition occurs in the case where the ignition timing is advanced by 2° as compared to a commercial spark plug was 1 point, and a point given when pre-ignition occurs in the case where the ignition timing is advanced by 2° as compared to the commercial spark plug was 0 points.

In the evaluation for combustion speed, a sample was mounted to an in-line 4-cylinder direct-injection turbo engine having a displacement of 1.6 L, and a combustion speed was measured under the conditions of a net mean effective pressure (NMEP) of 1000 kPa and an engine speed of 2000 rpm. The combustion speed was calculated from a time required for mass fraction burn (MFB) to reach 90% by mass from 10% by mass.

The combustion speed was evaluated by a score using the ratio by which the combustion speed was increased as compared to the commercial spark plug. Specifically, the combustion speed was evaluated as follows. A higher score indicates that the combustion speed is higher and also indicates that fuel economy is better.

20% or more: 3 points

5% or more and less than 20%: 1 point

Less than 5%: 0 points

Moreover, as overall evaluation, the sum of the score for pre-ignition and the score for combustion speed was calculated.

From the experimental results shown in FIG. 4, the following was found. Specifically, by comparing the experimental results of samples 1 and 9 to those of the other samples, it was found that occurrence of pre-ignition is inhibited when x−y is greater than 0. Meanwhile, by comparing the experimental results of samples 7, 8, 15, and 16 to those of the other samples, it was found that the combustion speed is increased when x−y is less than 0.2 mm.

Furthermore, by comparing the experimental results of sample 17 and sample 18 to each other and comparing the experimental results of sample 19 and sample 20 to each other, it was found that the combustion speed is higher when the distance b is larger than the distance a.

B. Other Embodiments

The present invention is not limited to the above-described embodiment and can be embodied in various configurations without departing from the gist of the present invention. For example, the technical features in the embodiment corresponding to the technical features in each aspect described in the Summary of the Invention section can be appropriately replaced or combined to solve part or all of the foregoing problems, or to achieve part or all of the foregoing effects. Further, such technical features can be appropriately deleted if not described as being essential in the present specification.

In the above-described embodiment, the metal shell 50 and the plug cover 80 are separate members, but are not limited thereto and may be integrated with each other. In addition, the ground electrode 30 is provided to the metal shell 50, but is not limited thereto and may be provided, for example, to the plug cover 80.

In the above-described embodiment, as shown in FIG. 3, the distance b from the central axis CB of the through hole 81 to the portion P1, at the frontmost side, of the outer open end E1 is larger than the distance a from the central axis CB to the portion P2, at the rearmost side, of the outer open end E1. However, the distance b is not limited thereto.

The distance b may be equal to the distance a, or may be smaller than the distance a.

DESCRIPTION OF REFERENCE NUMERALS

10: insulator
12: axial hole
13: leg portion
14: axial hole inner step portion
15: insulator step portion
17: front trunk portion
18: rear trunk portion
19: central trunk portion
20: center electrode
21: electrode member
22: core material
23: flange portion
30: ground electrode
31: noble metal tip
32: base end
33: front end portion
40: metal terminal
50: metal shell
51: tool engagement portion
52: mounting screw portion
53: crimp portion
54: seal portion
56: metal shell inner step portion
57: end surface
58: compressive deformation portion
63: ceramic resistor
64: seal body
65: gasket
66, 67: ring member
68: packing
69: talc
80: plug cover
81: through hole
82: screw portion
84: cover seal portion
86: screw groove
88: gasket
100: spark plug
CA: axial line
CB: central axis
D: through hole formation portion
Dn: inner portion
Dr: diameter reduction portion
E1: outer open end
E2: inner open end
P1: portion
P2: portion
R: auxiliary chamber
a: distance
b: distance
x: diameter
y: diameter

The invention claimed is:

1. A spark plug comprising:

a center electrode;

a ground electrode that is provided such that a gap for spark discharge is formed between the center electrode and the ground electrode; and a plug cover covering the center electrode and the ground electrode from a front side of the spark plug, the plug cover having a through hole, wherein the plug cover includes a diameter reduction portion formed in a range of 0.1 mm or less from an outer open end of the through hole in a direction along a central axis of the through hole and having a diameter gradually decreasing from the outer open end toward an inner open end of the through hole, and a relationship of 0 mm<x−y<0.2 mm is satisfied, where x is a diameter at the outer open end, and y is a diameter at an inner end of the diameter reduction portion.

2. The spark plug according to claim 1, wherein a distance from the central axis to a frontmost portion of the outer open end is larger than a distance from the central axis to a rearmost portion of the outer open end.

* * * * *